United States Patent [19]

Solano

[11] 4,149,939

[45] Apr. 17, 1979

[54] METHOD AND APPARATUS FOR FEEDING AN OXIDANT WITHIN A FURNACE ENCLOSURE

[75] Inventor: William E. Solano, Monroeville, Pa.

[73] Assignee: Salem Corporation, Pittsburgh, Pa.

[21] Appl. No.: 821,161

[22] Filed: Aug. 2, 1977

[51] Int. Cl.[2] ..... C10B 1/10; C10B 57/00; F27B 9/04; F27D 7/06

[52] U.S. Cl. ..... 201/27; 48/66; 75/21; 201/32; 201/40; 202/100; 202/103; 202/117; 202/136; 202/216; 266/186; 432/23; 432/72; 432/138

[58] Field of Search ..... 201/27, 32, 33, 40; 202/100, 103, 117, 136, 216, 218; 110/13, 36; 432/23, 72, 138, 139, 137; 266/145, 186; 48/66 (U.S. only)

[56] References Cited

U.S. PATENT DOCUMENTS

| | | | |
|---|---|---|---|
| 3,079,135 | 2/1963 | Buckholdt | 432/138 X |
| 3,434,931 | 3/1969 | Mansfield | 201/32 X |
| 3,470,068 | 9/1969 | Kemmerer, Jr. et al. | 201/33 |
| 3,594,286 | 7/1971 | Kemmerer, Jr. | 201/27 |
| 3,859,172 | 1/1975 | Wilt, Jr. | 202/117 |
| 3,966,560 | 6/1976 | Farago et al. | 201/32 |
| 3,998,703 | 12/1976 | Haviell | 201/32 |

*Primary Examiner*—Joseph Scovronek
*Attorney, Agent, or Firm*—Frank P. Cyr

[57] ABSTRACT

Method and apparatus for feeding an oxidant such as air and/or a fuel rich gas within the confines of a substantially air tight enclosure employed in the heat treatment of volatile containing materials which are deposited on the floor of a rotary hearth mounted within the enclosure. A larger number of air and/or fuel rich gas inlet ports are provided in the roof of the enclosure at the outer periphery thereof than at the central or intermediate areas of the enclosure to thus provide a more oxidizing atmosphere at the outer peripheral area of the enclosure than at the central and intermediate areas of the enclosure. The oxidant is admitted into the furnace enclosure through concentrically arranged rows of inlet openings formed in the roof of the enclosure. The oxidant mixes in the upper portion of the enclosure with the volatiles evolved from the materials and combusts therewith and following combustion of the said oxidant and released volatiles the waste gases of combustion are caused to travel radially outwardly to a peripherally mounted exhaust manifold whereas the materials undergoing heat treatment on the hearth are gradually advanced from the point of entry thereof to a centrally located discharge outlet. Means are provided in the exhaust manifold to cause said oxidant and waste gases of combustion to travel in a line of direction outwardly of the enclosure and into the said exhaust manifold. Thus, the direction of flow of the oxidant and waste gases of combustion within the enclosure is countercurrent to the direction of travel of the materials undergoing treatment on the hearth.

9 Claims, 9 Drawing Figures

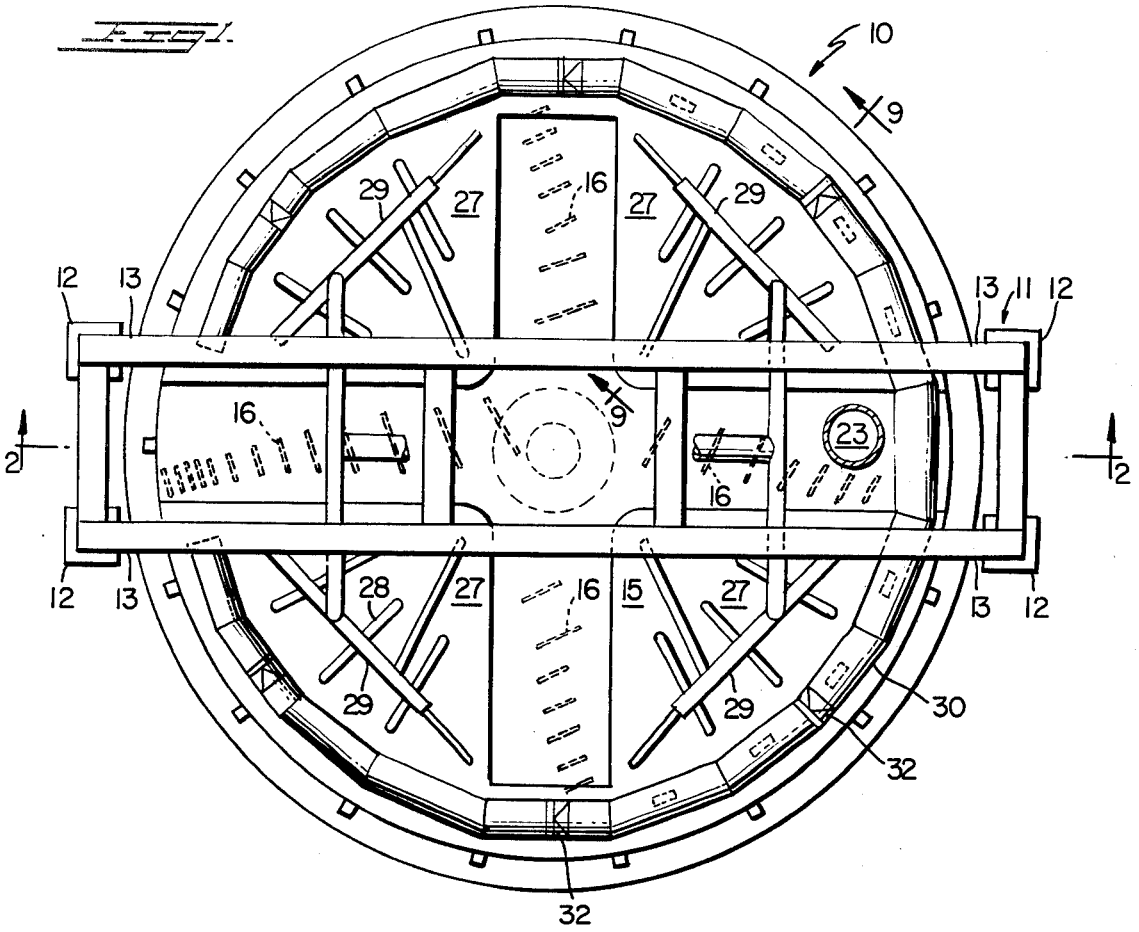
10
9
29
27
16
27
29
12
13
13
11
12
16
9
23
2
2
16
12
13
28
27
16
15
27
13
12
29
29
30
32
32
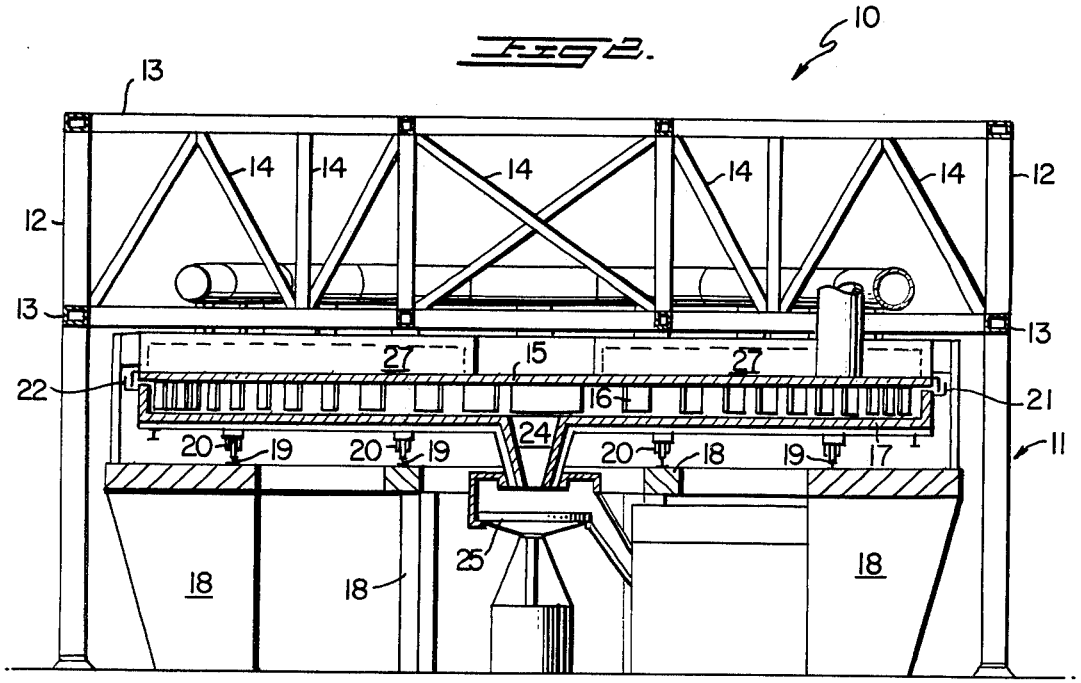
10
13
14
14
14
14
14
12
12
13
13
27
15
27
22
16
21
24
20
19
20
19
20
18
19
17
11
25
18
18
18

Fig 7.
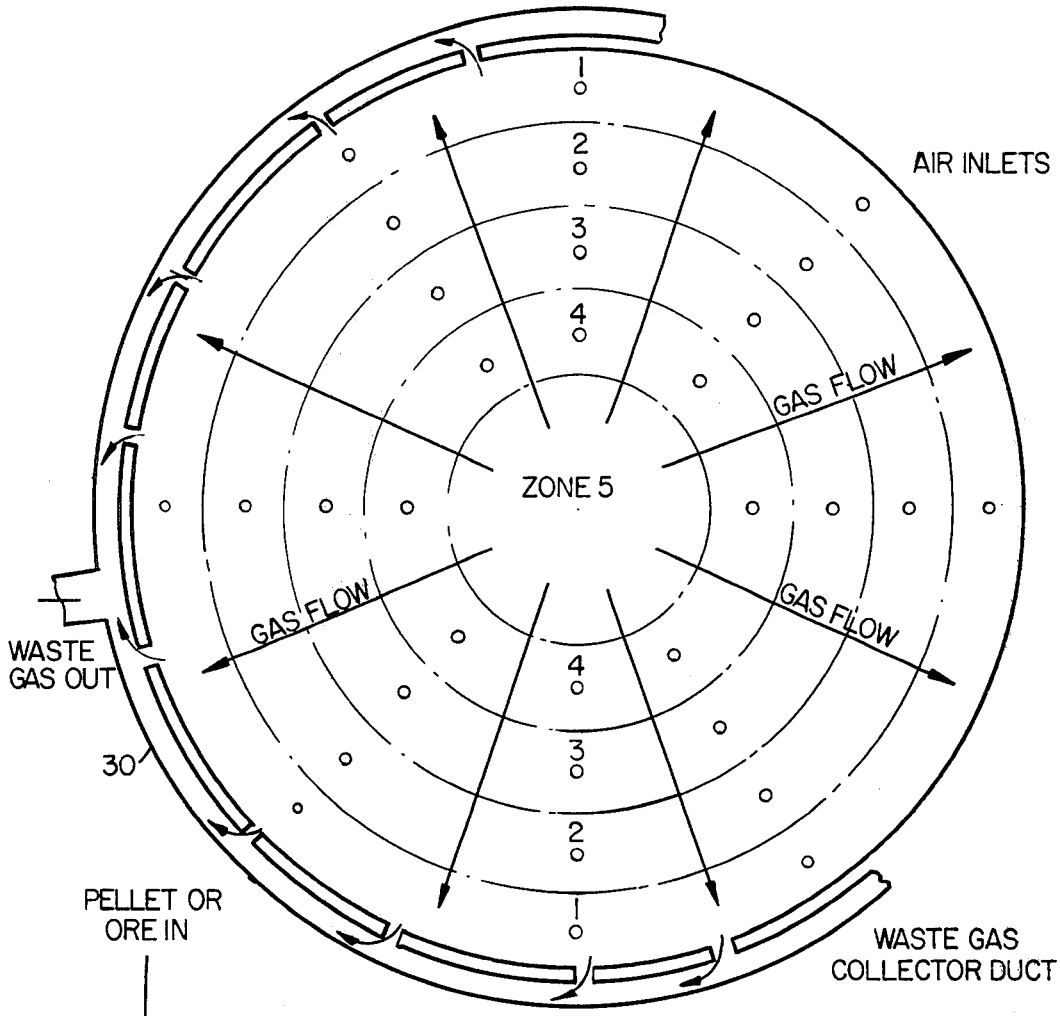
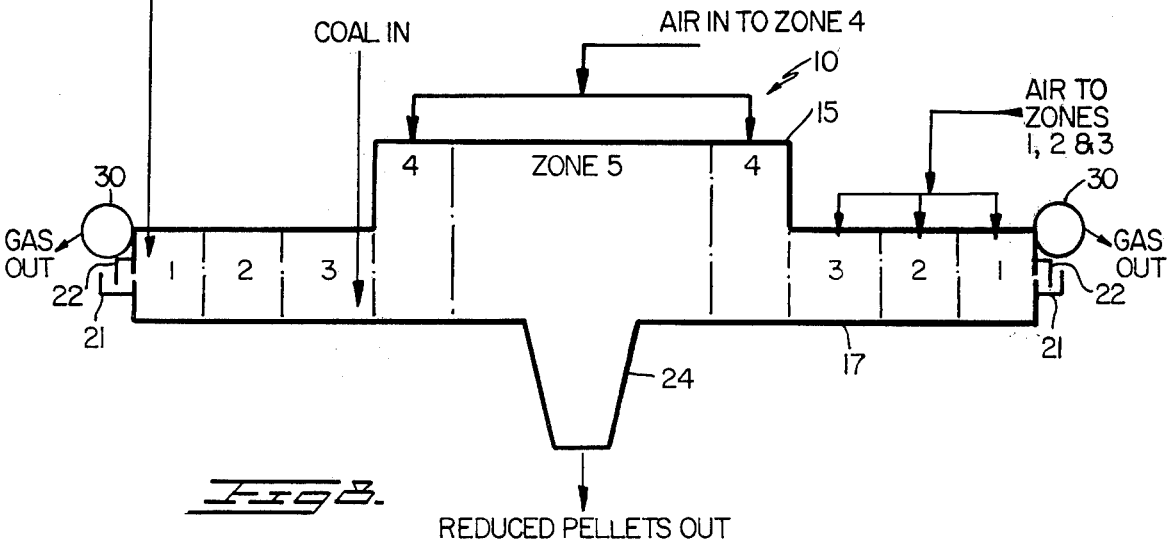
Fig 8.

METHOD AND APPARATUS FOR FEEDING AN OXIDANT WITHIN A FURNACE ENCLOSURE

BACKGROUND OF THE INVENTION

Rotary hearth furnaces or calciners for heat processing volatile containing materials therein are not new as shown in U.S. Pat. No. 3,470,068 to Kemmerer and Buschow; U.S. Pat. No. 3,998,703 to John B. Harrell and U.S. Pat. No. 3,859,172 to Charles R. Wilt, Jr.

In all of the aforesaid U.S. patents, there is shown a furnace or calciner comprising a roof, side walls and a hearth mounted for rotation therein. Volatile containing materials are fed into the furnace enclosure and deposited on the rotary hearth and subjected to a heat treatment while on said hearth. Roof and side wall openings are provided for the feed of air and/or a fuel rich gas within the furnace enclosure. Also, side wall mounted burners are provided to supply heat within the enclosure when such is needed. Operation of the furnace or calciner as shown and described in the aforesaid U.S. patents is substantially as follows. A volatile containing material or a combination of a volatile containing and a non-volatile containing material is fed onto the rotating hearth through a roof mounted port or ports and air and/or a fuel rich gas is admitted into the furnace enclosure through roof and/or side walls ports. Rabbles extend downwardly from the roof of the enclosure to a position in close proximity of the floor of the hearth and when the furnace is in operation, the rabbles progressively advance the materials toward a centrally located discharge port provided in the floor of the hearth. The volatiles evolved from the volatile containing materials undergoing treatment on the hearth rise towards the roof of the enclosure where they will mix with the air and/or fuel rich gas and combust therewith in that portion of the enclosure to provide an oxidizing atmosphere in that portion of the enclosure while maintaining a reducing atmosphere about the materials undergoing treatment on the floor of the hearth. Following combustion of the evolved volatiles with the aforesaid oxidants, the waste gases of combustion exit through a centrally located stack and ultimately into the surrounding atmosphere.

The furnaces or calciners constructed and designed to operate in the manner aforesaid have been proven to be very efficient in operation. However, it shoud be pointed out that in such prior known structures, the direction of travel of the volatile containing materials as well as the direction of the oxidant fed into the enclosure along with the waste gases of combustion all travel in the same direction, that is, the oxidant, waste gases of combustion as well as the material undergoing treatment on the hearth travel toward the central portion of the furnace enclosure and such flow of materials can be stated as being co-current.

In order to further improve on the efficiency of operation of a furnace or calciner constructed generally as aforesaid, certain structural changes have been made thereto and these changes and manner of operation of a furnace or calciner incorporating such changes will be set forth with particularity in the ensuing description of the invention.

With the above in mind, it is one of the objects of the invention to provide a means where an oxidant such as air and/or fuel rich gas fed into the furnace enclosure along with the waste gases of combustion are caused to flow in a direction of travel which is opposite or counter-current to the direction of travel of the materials undergoing treatment on the hearth.

Another object of the invention is to provide a plurality of roof mounted manifolds from which air and/or a fuel rich gas is directed into the upper portion of the furnace enclosure through a plurality of concentrically arranged rows of openings provided in the roof of the enclosure.

Another object of the invention is to provide an exhaust manifold about the periphery of the furnace or calciner enclosure with a means therein whereby the air and/or fuel rich gas along with the waste gases of combustion will be caused to travel radially outwardly of the furnace enclosure and directed into a peripherally mounted exhaust manifold and ultimately into the surrounding atmosphere.

Another object of the invention is to provide a larger number of air and/or fuel rich gas inlet ports in the outer periphery of the roof of the enclosure than at the center and intermediate areas of the enclosure.

Another object of the invention is to provide a means whereby air and/or fuel rich gas is admitted into the furnace enclosure in zonal areas, such that the gas atmosphere can be more strongly reducing at the center of the furnace than at the furnace periphery.

Another object of the invention is to provide a means whereby the temperature within the furnace enclosure can be profiled so as to provide for a lower temperature at or near the outer periphery of the enclosure than at the central or intermediate area of the enclosure.

The foregoing as well as additional objects of the present invention will be recognized from the following description of the several embodiments, references being made to the accompanying drawings.

DESCRIPTION OF THE DRAWINGS

FIG. 1 is a top plan view of a furnace or calciner constructed in accordance with the present invention.

FIG. 2 is a section taken on lines 2—2 of FIG. 1, looking in the direction of the arrows.

FIG. 7 is a schematic view of still further modification of the present invention.

FIG. 8 is a side elevation of the modification shown in FIG. 7, and,

DESCRIPTION OF THE PREFERRED EMBODIMENTS

Figure 3:
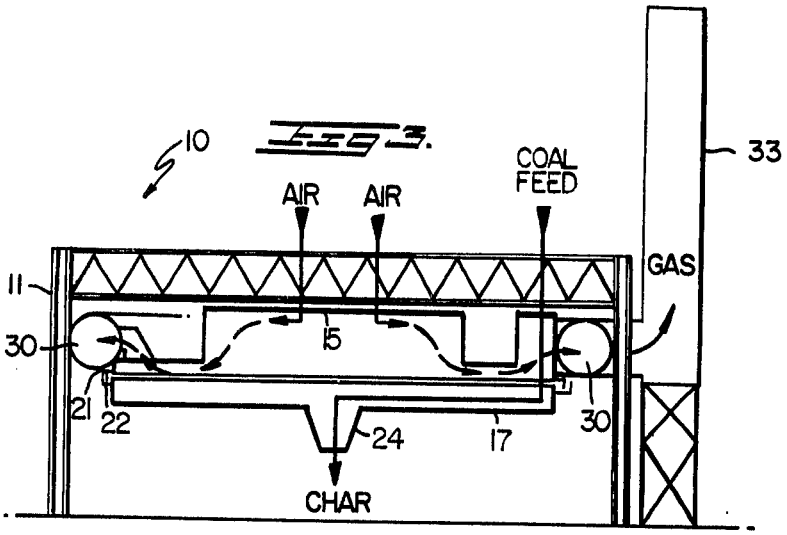
FIG. 3 is a schematic view of a calciner employed in the production of a char.

Before undertaking a detailed description of the structures shown in the accompanying drawings, it must be stated that the heat loss in previously known furnace or calciner structures such as set forth in the aforesaid U.S. patents is considerable and the present structure and manner of operation is designed to reduce such heat losses and to thereby improve on the efficiency of the furnace or calciner with resultant reduction in the costs for operating such a furnace or calciner.

In rotary hearth furnaces such as shown and described in the aforesaid U.S. patents, the materials to be subjected to a heat treatment while on said hearth are admitted into the furnace enclosure through a port or ports provided along the periphery of the enclosure. Normally, the volatile containing materials fed onto the rotating hearth are deposited thereon through a port or ports provided along the outer periphery of the enclosure and such materials are usually at surrounding atmospheric temperatures. The materials continuously heat as they are progressively advanced by means of rabbles towards the central exit provided in the hearth. As can be appreciated, the materials are heated by the furnace gas so the gas which leaves the central flue must be hotter than the materials heated. If furnace gases are made to flow from the furnace center to the outside by introducing air near the center and placing the gas exit flues at the periphery, then the furnace interior will be hotter near the center because this is where the air is available to burn the volatiles. This is unlike what is shown and described in the aforesaid U.S. Pat. No. 3,470,068 to Kemmerer and Buschow where a large quantity of air is admitted at the furnace periphery. The following description of the invention will set forth with clarity the structural changes over the aforesaid Kemmerer and Buschow patent as well as the manner of operation of a calciner incorporating such structural changes.

The present invention has a similar gas temperature profile to existing furnaces built in the manner described by Kemmerer and Buschow U.S. Pat. No. 3,470,068, that is, hotter near the center than at the outside. Because the present invention allows gases to be withdrawn from the outside, the gases leave at a lower temperature.

In the calcination of materials which are fed onto the floor of a rotary hearth furnace, it is pointed out that the materials fed thereon at the outer periphery of the enclosure must be subjected to a higher oxidizing atmosphere in that area than at the central portion of the enclosure and the following description of the invention will set this out with particularity.

Referring now to the drawings wherein like reference numerals are employed to designate like parts throughout the several views, reference numeral 10 designates generally a rotary hearth furnace or calciner constructed similarly to the structure shown in prior U.S. Pat. No. 3,470,068 to Kemmerer and Buschow, and this patent is incorporated herein by reference. The structure shown in the several views of the drawings are illustrative only and are not to be construed as limitations as to the type of furnace or calciner to which the present invention may be applied.

There is provided a framework 11 which consists of a pair of upright members 12 and a pair of horizontally extending beams 13 secured in any known manner to the upright members 12. Suitable cross members 14 extend between the horizontally extending beams 13 to add rigidity to the framework. A stationary roof 15 is supported by said framework 11 and sets of rabbles 16 are mounted in the roof 15 and they extend to a position closely adjacent to the floor of the hearth 17 which is mounted for rotation on a base 18 which is provided with trackways 19 on which hearth supporting rollers 20 travel. A trough 21 extends from the side wall of the hearth 17 and a flange 22 depends from the stationary roof 12 into the trough 21. The trough is filled with sand, oil, or the like, to provide a seal between the rotating hearth and the stationary roof. Any suitable means is employed for rotating the hearth when the furnace is in operation. A material feed inlet for the materials to be heat processed on the rotary hearth is shown at 23 and a material outlet 24 is provided centrally of the hearth 17. The materials passing through the outlet 24 are deposited on a receiving table 25 and removed from thereon in any suitable manner. Gas and/or oil fired burners (not shown) are provided in the stationary roof of the enclosure to supply heat therein when required.

Thus far, the structure described above is more or less conventional in rotary hearth furnaces and the improvement over such previously known structures will now be set forth in detail.

Figure 6:
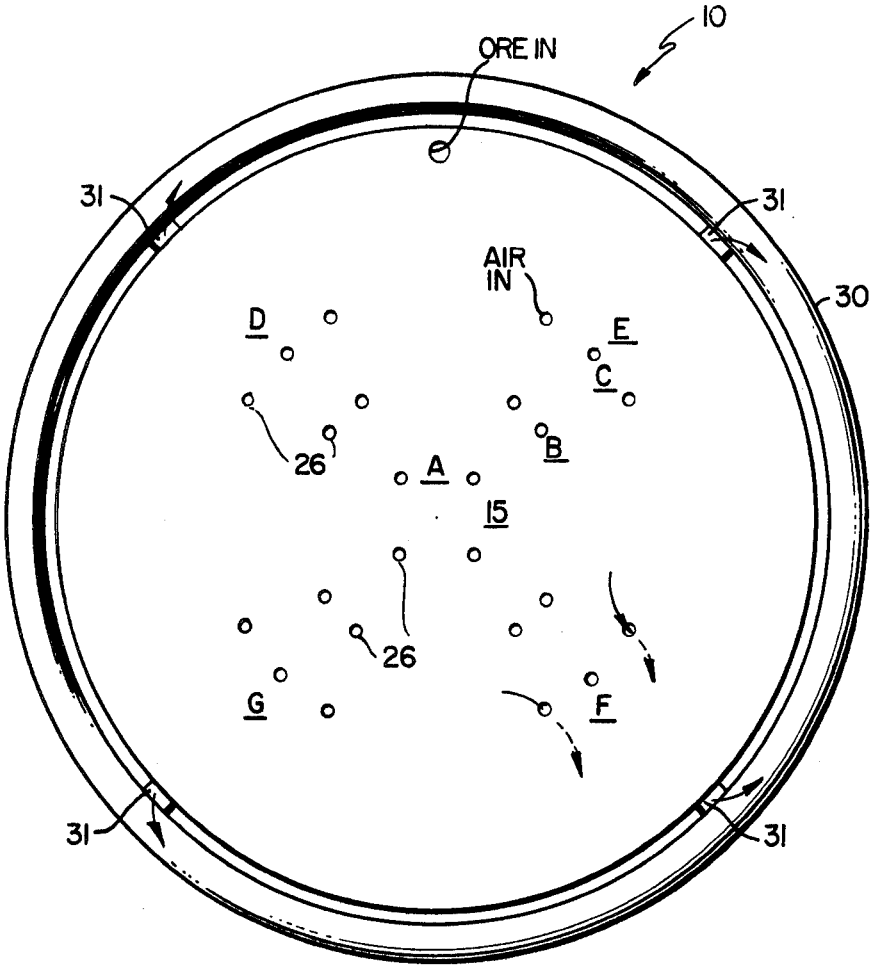
FIG. 6 is a top plan of the structure shown in FIG. 1 of the drawings with parts omitted to illustrate the arrangement of the oxidant admission ports in the roof of the calciner enclosure.

Referring now more particularly to FIG. 6 of the drawings which is a top plan view of the roof 15 of the enclosure, there is shown a plurality of air and/or fuel rich gas admission ports 26 and as shown, the admission ports are arranged in concentrically arranged rows A, B and C with a larger number of admission ports 26 in row C which is removed from but nearer to the outer periphery of the roof. As shown more clearly in FIG. 1 of the drawings, a plurality of manifolds 27 shown to be generally triangular in shape are formed in the roof of the furnace and conduits 28 extend from the manifolds into the enclosure from headers 29. Valves (not shown) are mounted in each of the conduits 28 so as to enable the operator of the furnace to regulate the amount of oxidant fed into the furnace enclosure from each of the conduits 28.

Figure 9:
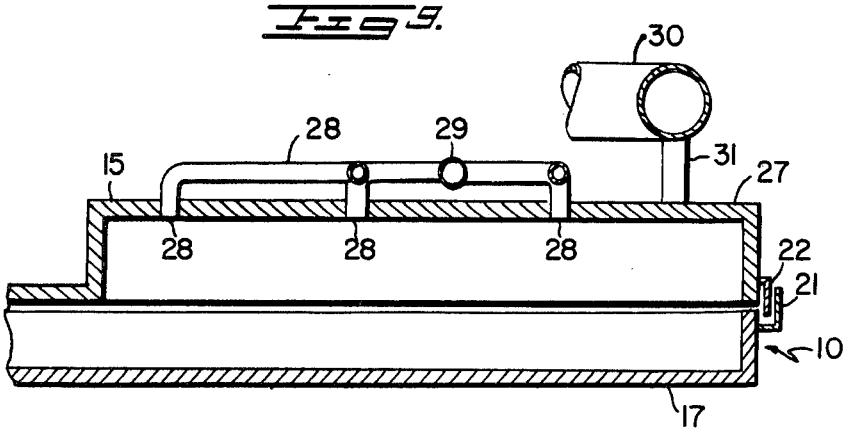
FIG. 9 is an enlarged section taken on lines 9—9 of FIG. 1, looking in the direction of the arrows.

As shown in FIGS. 1 and 9 of the drawings, each manifold 27 is provided with a header 29 and an oxidant such as air and/or a fuel rich gas is supplied to the manifolds 27 from a suitable source of supply (not shown). As shown in FIG. 1 of the drawings, four roof manifolds are provided and as shown in FIG. 6 of the drawings, four sets of admission ports 26 are provided and designated as areas D, E, F, G and one manifold 27 is provided for each set of admission ports. As can be appreciated, as many roof manifolds as well as admission ports may be provided depending on the furnace requirements, provided, of course, that admission ports be located near the central or intermediate areas of the enclosure for a purpose of the described more fully hereinafter. Supported on the framework 11 is an annular exhaust flue 30 which extends around the outer periphery of the furnace and conduits 31 extend from within the manifolds 27 for exhausting waste gases from within the furnace enclosure when the furnace is in operation. Exhaust fans 32 are mounted within the exhaust flue 30 and the waste gases of combustion from within the furnace enclosure are exhausted from therewithin by the exhaust fans and directed into a stack 33 and ultimately into the atmosphere.

Operation of the furnace or calciner described above is as follows. The temperature within the enclosure is elevated by initially firing roof mounted gas and/or oil burners (not shown). When the temperature within the enclosure has been elevated to a point where some of the volatiles in the materials to be heat processed therein are evolved therefrom, the materials are fed into the enclosure through the inlet feed 23 located at the outer periphery of the roof and rotary motion imparted to the hearth. The roof supported rabbles will engage with the incoming materials and gradually advance the same to a centrally located outlet 24. After the materials have moved well away from the periphery, they have absorbed sufficient heat so that volatile evolution begins. The volatiles evolved from the incoming materials will combine with the oxidant such as air and/or fuel rich gas admitted within the enclosure through the aforesaid roof admission ports 26, and combust therewith in the upper portion of the enclosure, and provide all or a portion of the heat required for the process. If additional heat is required, it may be supplied by admitting a fuel such as natural gas or coal at a point nearer the center of the furnace. This will make the gas atmosphere more reducing at the center of the furnace, because air flow to this region is controlled such that there is always an air deficiency near the center of the furnace. As the gas moves outward it encounters more air supplied to row C of air admission ports. The amount of air entering row C is controlled so that some oxygen is present in gases leaving the furnace. This makes the gas atmosphere more oxidizing at the periphery. Thus, it can be stated that the direction of flow of the incoming oxidant as well as the waste gases of combustion is counter-current to the direction of travel of the materials on the hearth which, as stated previously, is from the outer periphery of the enclosure to a centrally provided outlet port for the processed materials. Thus, unlike the known rotary hearth furnaces where the waste gases of combustion are drawn inwardly towards a centrally located stack, the gases of combustion in the improved structure are exhausted radially outwardly of the furnace enclosure. This is a considerable improvement over the central exhausting of gases of combustion. For example, in the operation of a conventional rotary hearth furnace where the waste gases exit through a central outlet stack and the processed materials are also directed to a centrally located outlet, there is a considerable amount of unused heat in the exiting waste gases. In the operation of the calciner designed to operate in the improved manner, aforesaid, the waste gases of combustion flow radially outwardly of the enclosure towards the incoming volatile containing materials, whereas the materials undergoing treatment on the hearth travel towards the centrally provided outlet for the processed materials.

By varying the number of oxidant admission ports in each of the concentric rows of admission ports formed in the roof of the enclosure, or by varying the amount of oxidant fed into the enclosure, the temperature as well as the gas composition within the furnace may be profiled so as to enable the furnace or calciner to operate on a more efficient basis. By gas composition within the enclosure is meant that at the center of the enclosure insufficient air or other oxidant is admitted, there is thus provided an area where the gas is more reducing in character than at the outer periphery and intermediate areas of the enclosure where more oxidants are admitted into the enclosure. The gases in the areas within the furnace enclosure wherein more oxidant is fed thereinto will be more oxidizing in character and since the number of oxidant admitting ports increase in number from the innermost row of such openings as shown in A in the drawings to the intermediate and outermost row of openings shown at B and C in the drawings, the gas composition within the furnace enclosure will vary from one which is substantially reducing in nature to one which is more oxidizing in nature. Also, as can be appreciated, the temperature profile within the enclosure will vary, depending on the quantity of volatiles burned in a given area and upon the ability of the charged material to absorb heat in that area. Thus, it can be stated that the gas composition as well as the temperature within the enclosure can be regulated by varying the number of oxidant admitting ports in each of the concentrically arranged row of admitting ports or by varying or regulating the amount of oxidant fed into each of the rows of oxidant admitting ports. This is a considerable improvement over the known prior rotary hearth furnace as the gas composition as well as the temperature within a rotary hearth furnace can be regulated to thus expose the materials undergoing a heat treatment on the hearth to the most ideal conditions to properly process the materials within the enclosure.

Figure 4:
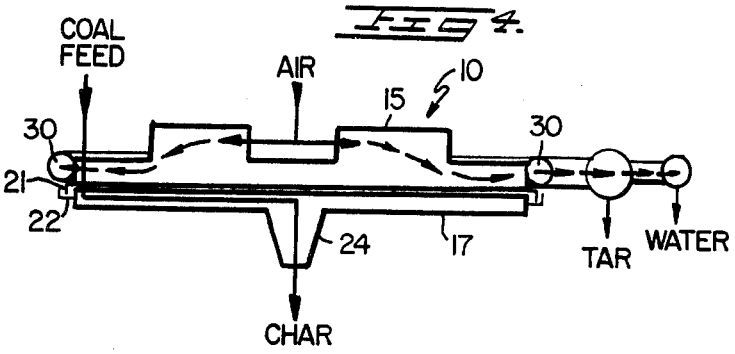
FIG. 4 is a schematic view of a calciner employed in the production of char, tar and fuel gas.

Shown in FIGS. 3 and 4 of the drawings are schematics of rotary hearth furnaces designed to operate on the same basic principles as that set forth above, that is, the direction of flow of the air and/or fuel rich gas or other oxidant fed into the furnace enclosure is counter-current to the direction of flow of the materials undergoing heat treatment on the hearth. In FIG. 3 of the drawings, a volatile containing material such as coal is fed onto the rotary hearth through a port provided at the outer periphery of the roof 15 and the same caused to be rabbled inwardly toward a central outlet 24 provided in the floor of the hearth. An oxidant such as air and/or fuel rich gas is admitted into the enclosure through admission ports located centrally of the roof and caused to travel radially outwardly of the enclosure by reason of the suction fans located in the exhaust flue 30. Of course, the waste gases of combustion within the enclosure will also be caused to travel radially outwardly of the enclosure. In FIG. 4 of the drawings, an installation similar to that shown in FIG. 3 is illustrated. Only, in this case, the tar and water are removed from the waste gases of combustion and a fuel gas is recovered and fed to a suitable receiver means.

Figure 5:
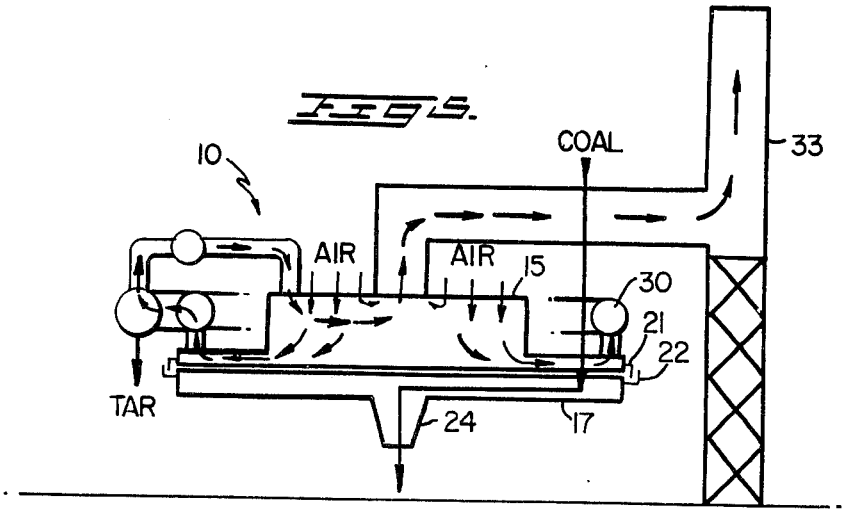
FIG. 5 is a schematic view of a modified form of a calciner employing the basic concept of the present invention.

Shown in FIG. 5 of the drawings is a still further modified schematic view of a rotary hearth designed to operate generally on the same basic principle described above, namely the counter-current flow of an oxidant along with the waste gases of combustion with respect to the materials undergoing heat treatment on the hearth. As shown in this figure of the drawings, a volatile containing material such as coal is fed onto the hearth of the furnace through an inlet port formed along the periphery of the enclosure. Air and/or a fuel rich gas or other oxidant is fed into the furnace enclosure through roof openings which are arranged in concentric rows, as aforesaid, and the exhaust fans in the exhaust flue 30 causes a portion of such oxidant and waste gases of combustion to travel radially outwardly of the furnace enclosure and into the exhaust flue 30. In this modification of the invention, following the counter-current direction of flow of a portion of the gases with respect to the materials undergoing treatment on the hearth, the waste gases of combustion in the exhaust flue are directed into a separator unit which is in communication with the interior of the enclosure where the tar is removed therefrom and the remaining waste gases are directed into the upper portion of the enclosure and pass into an exhaust stack via a central flue.

Shown in FIGS. 7 and 8 of the drawings is a still further modification of a rotary hearth designed to operate generally on the same basic principle described above, that is, the oxidant admitted into the rotary hearth enclosure as well as the gases of combustion are caused to travel in a direction which is counter-current to the flow of the materials undergoing treatment on the hearth. In the structure shown in FIGS. 7 and 8, the same can be employed for the direct reduction of metallized ores using coal as a reductant. Here, the metallized ore is introduced onto the rotating hearth through a port or ports provided along the outer periphery of the enclosure whereas coal or the like is introduced within the enclosure through a roof port or ports provided intermediate the central and outer areas of the furnace enclosure. The air and/or fuel rich gas or other oxidant is admitted into the furnace enclosure through openings formed in the roof of the enclosure, as aforesaid, and as schematically shown, the oxidant is admitted into what may be termed zonal areas designated generally as zones 1, 2 and 3. Thus, with the oxidant admission ports 26 provided in the roof of the enclosure and with the exhaust fans 32 provided in the exhaust flue 30, the oxidant as well as the waste gases of combustion are caused to travel in a line of travel to the exhaust flue which is counter-current to the line of travel of the materials which are undergoing treatment on the hearth and which are gradually being advanced towards the centrally located outlet 24.

Throughout the aforesaid description of the invention, it has been pointed out that all furnace or calciner structures shown in the drawings are designed to operate on the same principle, that is, the materials to be heat processed within a rotary hearth furnace or calciner enclosure are deposited on the floor of the hearth at or near the periphery of the hearth and the roof mounted rabbles gradually advance the materials towards a centrally located exit formed in the floor of the hearth whereas the oxidant fed into the enclosure as well as the waste gases of combustion are caused to flow in a direction of travel which is counter-current to the direction of flow of the materials on the said hearth.

Also, as set forth previously, by arranging the oxidant admission ports in concentric rows with each row having a greater or lesser number of admission ports in each concentric row as well as providing suitable valves in conduits 28, the operator of the furnace can regulate the amount of oxidant fed into the enclosure to thus regulate the temperature within the furnace enclosure as well as the gas composition therein. Thus, the operator of the calciner designed to operate in the improved manner, aforesaid, can heat-process therein various materials starting with a material having a high content of volatile matter therein to one having a low concentration of volatiles. This is rendered possible by regulating the amount of oxidant admitted into the calciner enclosure at the various zonal areas provided therein as well as utilizing the heat of the waste gases of combustion in heating the incoming materials into the enclosure as well as to provide an oxidizing atmosphere at or near the point of entry of such materials while maintaining a reducing atmosphere about the materials undergoing treatment on the hearth.

As pointed out in the aforesaid Kemmerer and Buschow patent, if the volatile containing materials release sufficient volatiles from therein which, when mixed with the oxidant, and combust therewith, provide all of the heat required to properly process the materials therein then the process can proceed on an autogenetic basis. Otherwise, oil or gas fired side wall mounted burners may be employed to furnish the added heat within the enclosure to insure the proper processing of the materials on the hearth of the calciner.

Although I have described in detail the preferred embodiments of my invention, I contemplate that many changes may be made without departing from the scope or spirit of my invention and I desire to be limited only by the claims.

I claim:

1. In a method of feeding an oxidant into a substantially air tight circularly shaped stationary enclosure having an imperforate hearth mounted for rotation therein on a vertical axis and wherein volatile containing materials evolving volatiles from therein when subjected to a heat treatment are fed into the said enclosure and deposited on said rotary hearth within the said enclosure and wherein said oxidant mixes in the upper portion of the enclosure and combusts therewith in the upper portion of the said stationary circularly shaped enclosure, the improvement comprising, depositing said volatile containing materials on the said hearth through inlet ports provided at the outer periphery of the said enclosure and gradually advancing said materials towards a centrally located outlet for the said materials while simultaneously feeding into said enclosure a lesser amount of oxidant at the central area of the enclosure than at the outer periphery thereof to thus provide a more reducing atmosphere at the central area of the enclosure than at the outer periphery area thereof, the oxidant and waste gases of combustion caused to travel outwardly to an externally mounted exhaust manifold, the direction of travel of said waste gases of combustion and said oxidant being counter-current to the direction of travel of said volatile containing materials.

2. The method recited in claim 1 wherein the materials undergoing treatment on the hearth are rabbled and caused to travel inwardly of the enclosure towards an outlet opening formed in the central portion of the floor of the rotary hearth.

3. An apparatus for subjecting volatile containing materials to a heat treatment within the confines of a substantially air tight circular enclosure comprising a roof, side walk and a rotary hearth mounted for rotation within said enclosure on a vertical axis, an inlet port for the said volatile containing materials formed at the periphery of the enclosure, rabbles mounted in the roof of the enclosure for progressively advancing said materials from the periphery of the said rotary hearth towards a central exit opening formed in the floor of the said hearth, a plurality of concentrically arranged rows of openings provided in the roof of the said enclosure for the feed thereinto of an oxidant which will mix with the evolved volatiles and combust therewith in the upper portion of said enclosure, a lesser number of openings being provided in the innermost row of openings than the number of openings provided in the outermost row of openings to thus provide for a more reducing atmosphere at the central portion of the enclosure while providing a more oxidizing atmosphere at the outer periphery of the enclosure, said oxidant and waste gases of combustion traveling radially outwardly of said circular enclosure and into an exhaust manifold mounted on the periphery of the said enclosure whereas the materials undergoing treatment on the hearth are rabbled and simultaneously progressively advanced to said central exit in the floor of the hearth.

4. The structure recited in claim 3 wherein a greater number of openings are provided in the row adjacent the periphery of the hearth than that provided in the next adjacent inwardly arranged concentric rows of openings to thereby permit for the feed of more oxidant into the said enclosure at the outer periphery thereof than at points intermediate the said outer periphery and the central portion of said enclosure.

5. The structure recited in claim 3 wherein said gas exhausting means is provided in the said exhaust manifold to draw the oxidant and waste gases of combustion radially outwardly of the enclosure and into the said manifold mounted on the periphery of the said circular enclosure.

6. The structure recited in claim 3 wherein roof mounted manifolds feed an oxidant in said concentrically arranged rows of openings provided in the roof of the said enclosure said manifolds having conduits extending therefrom and extending into the said enclosure, said conduits having valve means therein whereby the amount of oxidant fed into the said enclosure can be regulated thus regulating the heat generated within the said enclosure.

7. The structure recited in claim 3 wherein said concentrically arranged rows of openings in the roof of the enclosure defined zonal areas within the said enclosure whereby the oxidant fed through the said rows of openings may be regulated to feed into said zonal areas sufficient oxidants to provide the required degree of heat in the zonal areas to properly process the materials on the hearth.

8. In a method of feeding an oxidant into a substantially air tight circularly shaped stationary enclosure having an imperforate hearth mounted for rotation therein on a vertical axis and wherein volatile containing materials evolving volatiles from therein when subjected to a heat treatment are fed into the said enclosure and deposited on said rotary hearth within the said enclosure and wherein said oxidant mixes in the upper portion of the enclosure and combusts therewith in the upper portion of the said circularly shaped enclosure, the improvement comprising, depositing said volatile containing materials on the said hearth through inlet ports provided at the outer periphery of the said enclosure and gradually advancing said materials towards a centrally located outlet for the said materials while simultaneously feeding into said enclosure a lesser amount of oxidant at the central area of the enclosure than at the outer periphery thereof to thus provide a more reducing atmosphere at the central area of the enclosure than at the outer peripheral area thereof, the oxidant and waste gases of combustion caused to travel in a direction of travel towards the outer periphery of the said enclosure and into a separator unit for the removal of the tars from therein and following the removal of the said tars, the gases are caused to flow inwardly towards the central area of the said enclosure and to exit from within the said enclosure through an outlet provided in the roof of the said enclosure.

9. An apparatus for subjecting volatile containing materials to a heat treatment within the confines of a substantially air tight circular enclosure comprising a roof, side walls and a rotary hearth mounted for rotation therein on a vertical axis, an inlet port for the said volatile containing materials provided at the periphery of the enclosure, rabbles mounted in the roof of the enclosure for progressively advancing said materials from the periphery of the said rotary hearth towards a central exit opening formed in the floor of the said hearth, a plurality of concentrically arranged rows of openings provided in the roof of the said enclosure for the feed thereinto an oxidant which will mix with the evolved volatiles and combust therewith in the upper portion of said enclosure, said oxidant and waste gases of combustion first flowing in a direction of travel which is counter-current to the direction of travel of the materials undergoing treatment on the hearth, said gases flowing towards the outer periphery of said enclosure with said materials travelling towards the central portion of the said hearth, a separator unit extending along the outer periphery of said enclosure and being in communication therewith, said gases directed into said separator unit for the removal of tars from therein, said gases then being directed back into said enclosure and caused to travel in a direction of travel which is counter-current to the direction of travel of the materials on the hearth and to exit through an exhaust flue provided in the roof of the said enclosure.

* * * * *